United States Patent [19]

Eriksson et al.

[11] Patent Number: 5,047,096

[45] Date of Patent: Sep. 10, 1991

[54] FERRITIC-MARTENSITIC STAINLESS STEEL ALLOY WITH DEFORMATION-INDUCED MARTENSITIC PHASE

[75] Inventors: Hans F. Eriksson, Sandviken; Hakan F. R. Holmberg, Gävle, both of Sweden

[73] Assignee: Sandvik AB, Sandviken, Sweden

[21] Appl. No.: 257,830

[22] Filed: Oct. 14, 1988

[30] Foreign Application Priority Data

Oct. 26, 1987 [SE] Sweden ..... 8704155

[51] Int. Cl.[5] ..... C22C 38/58

[52] U.S. Cl. ..... 148/325; 148/327; 420/34

[58] Field of Search ..... 148/325, 327; 420/34, 420/56, 67, 57

[56] References Cited

U.S. PATENT DOCUMENTS 4,798,634 1/1989 McCune, III et al. ..... 148/325

4,798,635 1/1989 Bernhardsson et al. ..... 148/325

FOREIGN PATENT DOCUMENTS 0946268 4/1974 Canada ..... 148/325

OTHER PUBLICATIONS

Guy et al., *Elements of Physical Metallurgy*, Third Edition (1974) pp. 533–535.

European Search Report.

*Primary Examiner*—Deborah Yee

*Attorney, Agent, or Firm*—Burns, Doane, Swecker & Mathis

[57] ABSTRACT

The present invention relates to a ferritic-martensitic Mn-Cr-Ni-N-steel in which the austenite phase is transformed into martensite at cold deformation so that the steel obtains high strength with maintained good ductility. The distinguishing feature is an alloy analysis comprising max 0.1% C, 0.1–1.5% Si, max 5.0% Mn, 17–22% Cr, 2.0–5.0% Ni, max 2.0% Mo, max 0.2% N, balance Fe and normal amounts of impurities whereby the ferrite content is 5–45% and austenite stability, $S_m$, expressed as $S_m = 462$ (% C + % N) + 9.2% Si + 8.1% Mn + 13.7% Cr + 34% Ni shall fulfill the condition $475 < S_m < 600$.

10 Claims, No Drawings

FERRITIC-MARTENSITIC STAINLESS STEEL ALLOY WITH DEFORMATION-INDUCED MARTENSITIC PHASE

The present invention relates to a ferritic-martensitic stainless steel alloy (Mn-Cr-Ni-N-steel) in which the austenite phase is transformed to martensite during cold working so that the steel is given high strength whilst maintaining its good ductility.

Two phase ferritic-austenitic stainless steels are well established on the market and are primarily being used due to their good corrosion resistance combined with good strength. In certain applications such as tubes for oil and gas production is, however, the strength of such ferritic-austenitic steels not sufficiently good. A common method to increase the strength is to cold work the material. A systematically conducted development work now has shown that by careful optimization of the analysis it is possible to transform the austenite into martensite during coldworking. As a result thereof the strength is significantly increased compared with a steel alloy in which no transformation of the austenite occurred.

Fully austenitic stainless steels (such as AISI 301) having a deformation induced martensitic phase are often used as spring materials due to their good spring properties combined with a certain corrosion resistance. The ferritic-austenitic material according to this invention, however, gives substantial advantages compared with AISI 301 type materials, primarily in terms of lower alloying costs, better corrosion resistance and substantial advantages for the production of springs.

The strictly controlled, optimized analysis in weight percent for the alloys of the present invention is given below:

| | | |
|---|---|---|
| C | max | 0.1% |
| Si | | 0.1–1.5% |
| Mn | max | 5% |
| Cr | | 17–22% |
| Ni | | 2–5% |
| MO | max | 2.0% |
| N | max | 0.2% |

the remainder being Fe and normally occurring impurities.

The alloying costs are very critical and are restricted from requirements of the microstructure.

The microstructure shall include a ferrite content of 5–45% the remainder being an austenitic phase which upon cooling from high temperature, such as after hot working or annealing, is not transformed to martensite. During subsequent cold working the austenite phase is transformed into martensite. In order to obtain a maximum strength the austenite ought to have been transformed to martensite to highest possible degree after the last cold working step. The martensite formation also gives a substantial deformation hardening effect. This is very essential because a substantial degree of deformation hardening gives the material high deformation capability, i.e. the ability to obtain high degrees of deformation without exposing the material to cracking.

In order to fulfill these requirements simultaneously the effects obtained by each constituent must be known. Certain of these constituents promote ferrite formation whereas others promote austenite formation at those temperatures that apply during hot working and annealing. The ferrite promoting elements are primarily Cr, Mo and Si whereas the austenite promoting elements primarily are Ni, Mn, C and N. All these elements are to a variable degree contradicting the transformation of austenite to martensite during cold working.

The problem has been solved by providing the desired amount 5–45% of ferrite after annealing or hot working by means of thermodynamic equilibrium calculations in a computer which gives the suitable chemical compositions. The number of compositions is furthermore reduced due to the requirement that the austenitic phase shall be transformed to martensite during cold working but not during cooling. The tendency of such deformation has been possible to predict by means of an empiric formula which calculates the austenite stability versus martensite formation at deformation as a function of the chemical composition. Systematic investigations have shown that the austenite stability versus martensite formation ($S_m$) can be described by means of the formula:

$$S_m = 462(w\ \%\ C + w\ \%\ N) + 9.2\ w\ \%\ Si + 8.1\ w\ \%\ Mn + 13.7\ w\ \%\ CR + 34\ w\ \%\ Ni \quad (1)$$

in which the amounts refer to the amounts present in the austenite phase.

The development that resulted in this invention has shown that the $S_m$-value should be in excess of 475 but not in excess of 600 in order to avoid transformation of austenite into martensite during cooling whilst at cold working obtaining almost complete transformation after the last cold working step.

As appears from the foregoing it is very critical to keep the optimum alloy constituents. In the following a description of the effects of the various constituents is given together with an explanation of the limitations of said alloy constituents.

The amount of carbon should be limited to 0.06 weight percent, preferably less than 0.03%. The reason for this limitation is that there is a risk of carbide precipitations at heat treatments and annealing at higher carbon amounts. Carbide precipitations are of disadvantage because they result in decreased strength and increased risk of corrosion primarily pitting corrosion. However, carbon also has positive and useful properties. Carbon promotes deformation hardening primarily because the hardness increases in the martensite. In addition carbon is an austenite former by means of which optimum phase proportions are obtainable. As appears from the formula above carbon will substantially stabilize the austenite phase towards deformation into martensite. Therefore the carbon content should exceed 0.01%.

Silicon facilitates the metallurgical manufacture and is therefore important. Silicon also provides a relatively strong increase of the ferrite content. High amounts of silicon increases the tendency to precipitation of intermetallic phases. The amount of silicon is therefore limited to max 1.0%, preferably max 0.8%. The amount of silicon should be larger than 0.1%.

Manganese has several important effects on the alloy of this invention. It has surprisingly been found that it increases the extension of the ferrite-austenite two-phase area in the thermodynamic phase diagram. This means that manganese facilitates the possibility to optimize the amount of other alloy constituents in order to reach the desired point in the phase diagram, i.e. to obtain the desired proportions of ferrite and austenite.

Manganese also surprisingly plays an important role for obtaining the right austenite stability towards martensite formation. It has been found that manganese to a larger extent stabilizes the austenite phase towards martensite formation at cooling than compared at deformation. The result of this is that the deformation temperature at high Mn-contents easier can be used as a means for obtaining the almost complete transformation to martensite after the last cold working step.

Too high amounts of manganese will decrease the corrosion resistance in acids and chloride containing environments. The amount of manganese should therefore exceed 1% but should be limited to amounts less than 5% and preferably lower than 4%.

Chromium is an important alloy constituent from several aspects. It increases nitrogen solubility in both solid phase and in the melt. This is important since nitrogen, as described below, is a very central constituent and should be present in relatively high amounts in the alloy of the present invention. The amount of chromium should be high in order to obtain good corrosion resistance. The chromium content should in general be higher than 13% to make the steel stainless. The alloy of the present invention will, as described below, be advantageously subject of annealing whereby primarily high chromium containing nitrides will be precipitated. In order to reduce the tendency for a too drastical reduction of the chromium content the amount of the latter should be higher than 17%.

Chromium is also a strong ferrite former and increases the austenite stability towards martensite formation. High chromium content also increases the tendency for precipitation of intermetallic phases and the tendency for 475°-embrittlement in the ferrite phase. The chromium content should therefore be max 22%.

Nickel is also a constituent which has several important properties. Nickel is also a strong austenite former which is important for obtaining desired portion of ferrite. Nickel also increases the austenite stability towards martensite formation both at cooling from high temperature and at cold working. Nickel is also an expensive alloy constituent. It is therefore surprisingly advantageous to use low amounts of nickel at the same time as the requirements of ferrite portions and austenite stability can be fulfilled. The nickel content should therefore be higher than 2.0%, preferably higher than 2.5% and lower than 5% usually lower than 4.5%, and preferably lower than 4.0%.

Molybdenum has both ferrite forming and austenite stabilizing effects similar to chromium. Molybdenum, however, is an expensive alloy constituent. Molybdenum has a positive effect on corrosion properties why certain small amounts thereof could be added. Since the effects of molybdenum are the same as those of chromium presence of a high amount of molybdenum would necessitate a reduction of the chromium content. The result would be a non-desirable decrease of the nitrogen solubility since chromium gives a great increase of nitrogen solubility as addressed above. The molybdenum content should therefor be lower than 2.0%, usually lower than 1.5% and preferably lower than 0.8%. The molybdenum content should also preferably be higher than 0.1%.

Nitrogen has in steel alloys of the present type effects similar to those of carbon, but nitrogen has advantages in comparison with carbon. It has surprisingly been found that annealing after completed cold working gives a very remarkable increase in strength when nitrogen is present in the alloy. The reason therefor is that the annealing step results in a very fine disperse nitride precipitation which acts like precipitation hardening.

Nitrogen also essentially promotes an increase of the resistance towards pitting corrosion. It has also been found that nitride precipitations obtained during annealing gives a less serious sensibilization than compared with carbide precipitations obtained at high carbon contents. Due to the high nitrogen content in the alloy of this invention the carbon content can be maintained at a low level. In order to take advantage of the effects of nitrogen on the deformation hardening, austenite formation, austenite stability and pitting corrosion resistance the content of nitrogen should be higher than 0.08% and lower than 0.20%.

In the following a more concrete presentation of the invention and the results from its development will be made. Details about microstructure and properties, primarily mechanical properties will be given.

The manufacture of this material includes first melting and casting at about 1600° C. followed by heating at about 1200 C. and working by forging to bar shape. Thereafter the material was subjected to hot working by extrusion to obtain a round bar or hot rolling for obtaining strip at a temperature of 150°-1220° C. Test bars were made for various testing purposes. Quench-annealed material was heat treated at 1000°-1050° C.

The chemical analysis of the alloys of the development program appears from the Table 1 below.

TABLE 1

| Steel No. | C | Si | Mn | P | S | Cr | Ni | Mo max | N |
|---|---|---|---|---|---|---|---|---|---|
| | Chemical analysis (weight-%) of test alloys | | | | | | | | |
| 328 | .017 | .52 | 3.98 | .006 | .0026 | 20.22 | 2.12 | 0.3 | .15 |
| 332 | .018 | .44 | 2.30 | .006 | .0021 | 19.97 | 2.91 | 0.3 | .13 |
| 451 | .018 | .46 | 4.25 | .007 | <.003 | 20.34 | 3.08 | 0.3 | .14 |
| 450 | .021 | .51 | 2.90 | .006 | <.003 | 20.33 | 4.65 | 0.3 | .14 |
| AISI 301 | .12 | .89 | 1.24 | .006 | .0020 | 16.89 | 6.89 | — | .04 |

The nominal chemical analysis of these alloys were calculated thermodynamically by computer so as to obtain optimal microstructure. The microstructure of these alloys was controlled. The ferrite- and martensite portions of the annealed strips appear from Table 2 below.

TABLE 2

Microstructure of annealed hot rolled strips from test alloys.

| Steel No. | Anneal. temp. °C. | % ferrite | % martensite |
|---|---|---|---|
| 328 | 1000 | 42 | 0 |
| 332 | 1000 | 39 | 0 |
| 451 | 1050 | 38 | 0 |
| 450 | 1050 | 20 | 0 |
| AISI 301 | 1050 | <1 | 0 |

The austenite stability ($S_m$) at cold working according to formula (1) appears from table 3.

TABLE 3

Austenite stability towards martensite formation ($S_m$) in the test alloys.

| Steel No. | $S_m$ |
|---|---|
| 328 | 480 |
| 332 | 481 |
| 451 | 518 |
| 450 | 544 |

TABLE 3-continued

| Austenite stability towards martensite formation ($S_m$) in the test alloys. | |
|---|---|
| Steel No. | $S_m$ |
| AISI 301 | 558 |

Hence, the austenite stability lies in the desired range 475–600.

The impact resistance at room temperature for bar material appears from table 4.

TABLE 4

| Impact resistance (J) (Charpy V) of test alloys | | | |
|---|---|---|---|
| Steel No. | Extruded bar | Extruded heat treated bar | Heat treating temp. (°C.) |
| 328 | >300 | >300 | 1000 |
| 332 | >300 | >300 | 1000 |

Hence, the impact resistance is very good for this material in both conditions.

As appears from the foregoing it is very essential that material of this invention exhibits a strong deformation hardening during the cold working steps. In table 5 is shown how the hardness increases with increased degree of deformation.

TABLE 5

| Vicker-hardness of test alloys at increased degree of cold working. | | | | | |
|---|---|---|---|---|---|
| Steel No. | 328 | 332 | 451 | 450 | AISI 301 |
| quench-annealed | 248 | 240 | 219 | 214 | 182 |
| 33% def | 408 | 398 | 365 | 385 | 370 |
| 50% def | 402 | 429 | 418 | 441 | 428 |
| 75% def | 483 | 514 | 460 | 482 | 525* |

*70% def.

All alloys exhibit a strong deformation hardening which is typical for materials with deformation induced martensite.

The strength of the alloys during uni-axial tensile testing as a function of cold working degree appears from table 6 wherein Rp 0.05 and Rp 0.2 represents the load which gives 0.05% and 0.2% remaining strain, Rm represents the maximum load in the stength-strain diagram and A10 represents the change in length of the test bar expressed as A10=11.3 $S_o$ represents the measured original cross sectional area of the test bar.

TABLE 6

| Yield point, tensile strength, elongation and contraction of test alloys. | | | | | | |
|---|---|---|---|---|---|---|
| Steel No. | Condition | Rp 0.05 (Mpa) | Rp 0.2 (Mpa) | Rm (Mpa) | A10 (%) | Contr. (%) |
| 328 | annealed | 380 | 480 | 804 | 42 | 62 |
| | 50% def | 1148 | 1438 | 1524 | 3.3 | |
| | 75% def | 1215 | 1684 | 1807 | 1.9 | |
| 332 | annealed | 297 | 408 | 863 | 34 | 65 |
| | 50% def | 1166 | 1439 | 1508 | 5.2 | |
| | 75% def | 1302 | 1722 | 1807 | 1.1 | |
| 451 | annealed | 278 | 415 | 752 | 50 | |
| | 33% def | 732 | 946 | 1099 | 15.5 | |
| | 50% def | 1070 | 1255 | 1405 | 5.3 | |
| | 75% def | 1125 | 1627 | 1766 | 2.4 | |
| 450 | annealed | 282 | 400 | 753 | 55 | |
| | 33% def | 768 | 987 | 1137 | 16.0 | |
| | 50% def | 1108 | 1358 | 1488 | 6.2 | |
| | 75% def | 1324 | 1738 | 1845 | 3.0 | |
| AISI | annealed | 230 | 270 | 811 | 46 | 65 |
| 301 | 70% def | 1756 | 2080 | 2113 | 1.6 | |

Material type AISI in cold rolled condition is often subjected to annealing in order to obtain a further increase in strength. Annealing tests were also made with ferritic-martensitic alloys according to the present invention. It was found that the most positive effects of annealing were obtained when treated 400° C./2h (steels No. 328 and 332 and AISI 301) or 450° C./1 h (steels No. 451 and 450). The effects obtained with test alloys that were annealed appear from table 7.

TABLE 7

| Yield point, tensile strength and elongation after annealing of cold rolled sheet material. Change in percentage compared with cold rolled condition. | | | | | |
|---|---|---|---|---|---|
| Steel No | Condition | Rp 0.05 (Mpa) | Rp 0.2 (Mpa) | Rm (Mpa) | A10 (%) |
| 328 | 50% def | 1367 (19) | 1603 (11) | 1603 (5) | 2.3 (−30) |
| | 75% def | 1700 (40) | 1916 (14) | 1942 (7) | 3.4 (−44) |
| 332 | 50% def | 1451 (24) | 1626 (13) | 1646 (9) | 2.8 (−46) |
| | 75% def | 1767 (36) | 1907 (11) | 1907 (6) | 1.3 (18) |
| 451 | 33% def | 955 (30) | 1127 (19) | 1230 (12) | 7.4 (−52) |
| | 50% def | 1280 (20) | 1460 (16) | 1518 (8) | 4.3 (−23) |
| | 75% def | 1589 (41) | 1827 (12) | 1862 (5) | 2.0 (−17) |
| 450 | 33% def | 865 (13) | 1146 (16) | 1294 (14) | 6.5 (−59) |
| | 50% def | 1277 (15) | 1545 (14) | 1601 (8) | 3.8 (−39) |
| | 75% def | 1647 (24) | 1941 (12) | 1964 (6) | 2.3 (−23) |
| AISI 301 | 70% DEF | 2046 (17) | 2238 (8) | 2238 (6) | 1.3 (−19) |

The ferritic-martensitic alloys exhibit a suprisingly good effect after annealing, especially the Rp 0.05-values increase substantially. This is essential since the RP-0.05 values are those measured values which are best correlated with the elastic limit which is of importance in spring applications. Spring forming operations which normally are carried out before annealing are easier to carry out on material of this invention due to the lower elasticity limit. The high elasticity limit after annealing gives a high load carrying ability in practical usage of springs.

The normal annealing time for material of the type AISI 301 is essentially longer (about 4h) than what is optimal for alloys of the present invention. This difference gives essential productivity improvements when manufacturing products which are to be used in annealed condition.

In order to get an indication about the deformation ability the material was also subjected to a ductility test by bending at 90° to smallest possible radius without crack formation. Because of such high degree of cold working large difference are obtained if such bending is carried out longitudinally or transversely in relation to the rolling direction. The results are plotted below in table 8.

TABLE 8

| Bending ability as function of reduction degree in cold rolled and annealed condition. | | | | | |
|---|---|---|---|---|---|
| | | Smallest bending radius coldrolled | | Smallest bending radius annealed | |
| Steel No. | Condition | ‖ | ⊥ | ‖ | ⊥ |
| 328 | 33% def | — | — | — | — |
| | 50% def | >10 t | 6.3 t | >10 t | 6.3 t |
| | 75% def | 10 t | >10 t | >10 t | >10 t |
| 332 | 33% def | — | — | — | — |
| | 50% def | >10 t | 6.3 t | >10 t | 5 t |
| | 75% def | >10 t | 6.3 t | >10 t | 2.8 t |
| 451 | 33% def | 4 t | 0.2 t | 4 t | 0.7 t |
| | 50% def | >6.7 t | 2 t | 6.7 t | 2.7 t |
| | 75% def | >10 t | 6.7 t | 10 t | 3.3 t |
| 450 | 33% def | 4 t | 0.4 t | 2.1 t | 0.6 t |
| | 50% def | >6.7 t | 2 t | 6.7 t | 2 t |
| | 75% def | >10 t | 5.3 | 10 t | 3.3 t |

TABLE 8-continued

| Bending ability as function of reduction degree in cold rolled and annealed condition. | | | | | |
|---|---|---|---|---|---|
| | | Smallest bending radius coldrolled | | Smallest bending radius annealed | |
| Steel No. | Condition | ‖ | ⊥ | ‖ | ⊥ |
| AISI 301 | 70% def | >10 t | >10 t | >10 t | >10 t |

The results show that the ferritic-martensitic alloys maintain a good ductility also at high strength levels. Further, the strength increase obtained from annealing does not negatively affect the bending properties. The results show that the alloys of the present invention are obtainable exhibiting the combination of high strength with maintained ductility. The results above also indicate that a high strength of AISI 301 is combined with decreased bending properties which reduced the forming ability of said material.

The requirement of corrosion resistance are moderate for this type of material. If the material is subject of stresses it is often the risk for pitting and crevice corrosion that are dominating. Potentiostatic measurements of the critical temperature for pitting corrosion CPT (Critical Pitting Temperature) in chloride environments gives a practically very useful value of the pitting corrosion resistance. Such measurements are visualized in Table 9. The measurements are made in 0.1% NaCl and after applying to the test piece a potential of 300 mV measured in relation to a saturated calomel electrode.

TABLE 9

| Critical temperature for pitting corrosion (CPT) for test alloys (300 mV/SCE, 0.1% NaCl) | |
|---|---|
| Steel No. | CPT °C. |
| 328 | 39 |
| 332 | 43 |
| AISI 301 | 10 |

It appears that the ferritic-martensitic alloys of the present invention exhibit a substantially better corrosion resistance towards pitting than compared with AISI 301.The reason is obviously that these ferritic-martensitic alloys have an analysis which is better optimized than AISI 301 also with regard to pitting corrosion resistance.

We claim:

1. A duplex stainless steel alloy with high strength and good ductility in which the microstructure after cooling from high temperature contains ferrite and metastable austenite, said mestastable austenite being capable of being transformed into martensite during subsequent cold-working, which alloy consists essentially of, in percent by weight:

| | |
|---|---|
| C: | max 0.1% |
| Si: | 0.1-1.5% |
| Mn: | above about 2% to max 5% |
| Cr: | 17% to below 21% |
| Ni: | 2-5% |
| Mo: | max 2.0% |
| N: | max 0.2%, |

in which the alloying elements are adjusted such that the following conditions are fulfilled: the ferrite content is from 5-45 volume % and the numerical value for austenite stability versus martensite formation, $S_m$, expressed as $S_m=462(\%\ C+\%\ N)+9.2\%\ Si+8.1\%\ Mn+13.7\%\ Cr+34\%\ Ni$ is in the range $475<S_m<600$.

2. The alloy as defined in claim 1, wherein the carbon content has a maximum percentage of 0.06.

3. The alloy as defined in claim 2, wherein the carbon content has a maximum percentage of 0.03.

4. The alloy as defined in claim 1, wherein the silicon content is from 0.1-1.0%.

5. The alloy as defined in claim 1, wherein the nickel content is from 2.5-4.5%.

6. The alloy as defined in claim 1, wherein the nickel content is from2.5-4.0%.

7. The alloy as defined in claim 1, wherein the molybdenum content is from 0.1-0.8%.

8. The alloy as defined in claim 1, wherein the nitrogen content is from 0.08-0.20%.

9. The alloy as defined in claim 1, wherein the molybdenum content has a maximum percentage of 1.5%.

10. A cold-worked, wrought duplex stainless steel alloy with high strength and good ductility in which the microstructure after cold-working contains ferrite and martensite, during cold-working, which alloy consists essentially of, in percent by weight:

| | |
|---|---|
| C: | max 0.1% |
| Si: | 0.1-1.5% |
| Mn: | above about 2% to max 5% |
| Cr: | 17% to below 21% |
| Ni: | 2-5% |
| Mo: | max 2.0% |
| N: | max 0.2%. |

in which the alloying elements are adjusted such that the following conditions are fulfilled: the ferrite content is from 5-45 volume % and the numerical value for austenite stability versus martensite formation, $S_m$, expressed as $S_m=462(\%\ C+\%\ N)+9.2\%\ Si+8.1\%\ Mn+13.7\%\ Cr+34\%\ Ni$ is in the range $475<S_m<600$.

* * * * *